US006428288B1

(12) United States Patent
King

(10) Patent No.: US 6,428,288 B1
(45) Date of Patent: Aug. 6, 2002

(54) FLUID PUMPS

(76) Inventor: Peter J. King, 31 Morning Glory Drive, Lake Cooroiban, QLD 4565 (AU)

( * ) Notice: Subject to any disclaimer, the term of this patent is extended or adjusted under 35 U.S.C. 154(b) by 0 days.

(21) Appl. No.: 09/806,905

(22) PCT Filed: Mar. 12, 2001

(86) PCT No.: PCT/AU98/00751

§ 371 (c)(1),
(2), (4) Date: Mar. 12, 2001

(87) PCT Pub. No.: WO00/15963

PCT Pub. Date: Mar. 23, 2000

(51) Int. Cl.[7] ..... F04B 39/06

(52) U.S. Cl. ..... 417/366; 417/352; 417/423.1; 417/423.14; 417/366; 415/204; 415/205; 415/206; 415/191; 415/176

(58) Field of Search ..... 417/352, 423.1, 417/423.14, 366; 415/204, 205, 206, 191, 176

(56) References Cited

U.S. PATENT DOCUMENTS 5,288,215 A * 2/1994 Chancellor et al. .... 417/423.11

FOREIGN PATENT DOCUMENTS

JP 08093684 A * 4/1996 ..... 417/423.11

* cited by examiner

*Primary Examiner*—Charles G. Freay
*Assistant Examiner*—Emmanuel Sayoc
(74) *Attorney, Agent, or Firm*—Donald J. Ersler

(57) ABSTRACT

An air pump assembly (10) is provided which has a through flow type air-driving device (12) supported on an apertured partition wall (18) with the air-driving device (12) at one side and the motor (50) at the opposite side. The wall (18) is sandwiched between opposed pump and motor housings (14and 16) providing complementary ducts (27and 28) which communicate with opposed end caps (25 and 26) mounted on the end walls (21 and 22) of the pump and motor housings (14 and 16). The pump housing end wall (21) is apertured for air flow into the air-driving device (12) from the end cap (25) and its side wall supports an air outlet connection (13). A circuitous inlet passage to the air-driving device (12) is formed through end cap (26), ducts (27 and 28) and end cap (25). A circuitous outlet passage is formed from the air-driving device (12) through the motor housing (16), apertured partition wall (18) and motor housing (16).

19 Claims, 1 Drawing Sheet

FLUID PUMPS

Figure 1:
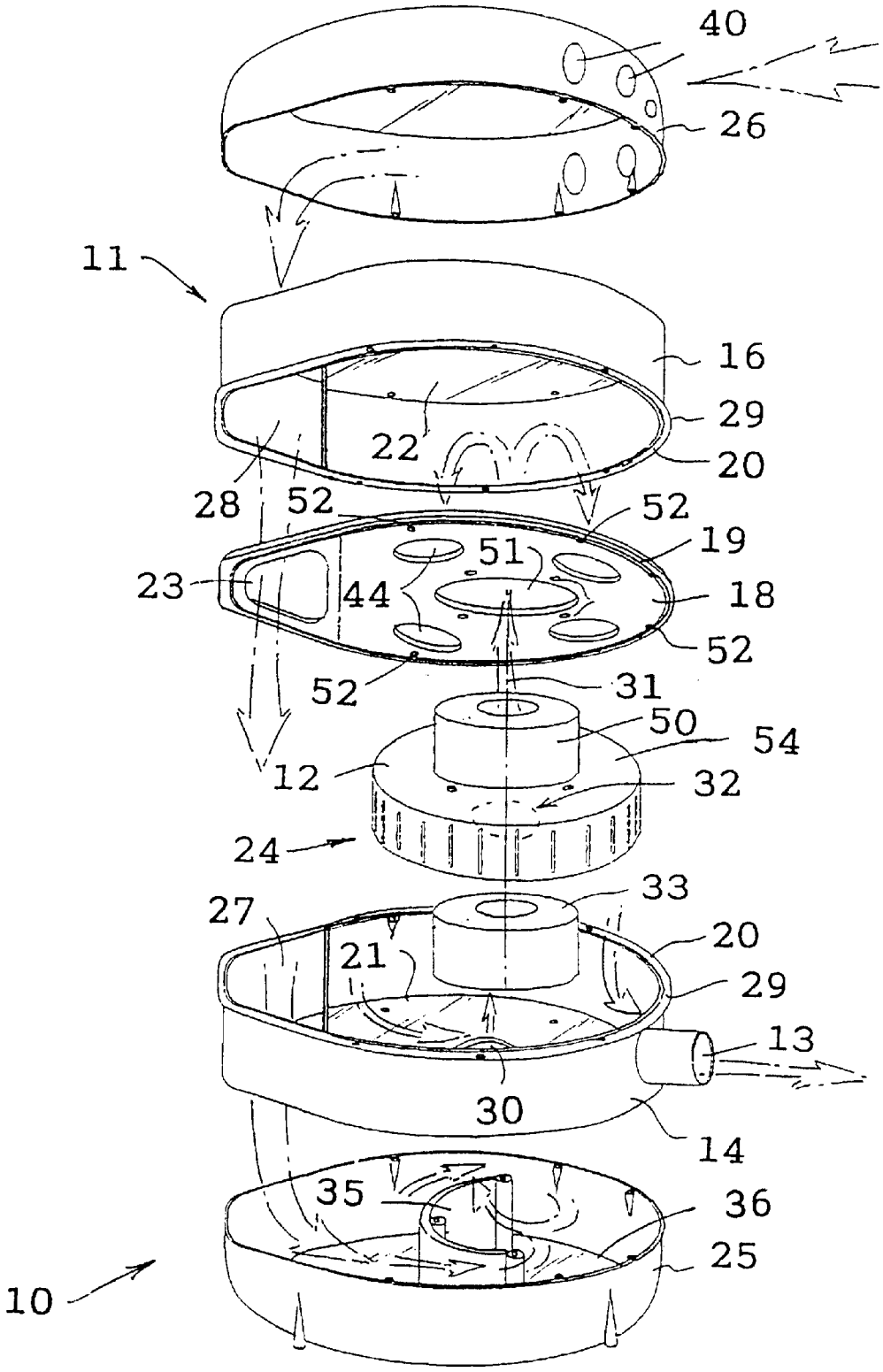

This invention relates to fluid pumps and in particular to air pump assemblies.

This invention has particular application to air pump assemblies which may be used for light duty applications such as for supplying air to domestic spas and the like and particular reference will be made hereinafter to such applications. However this invention is not limited to such light duty applications and embodiments thereof may be used for supplying air to commercial spa baths or in industry for processing or supply applications where an air supply or suction effect is required.

The presently available light duty spa pump assemblies mostly utilize air pump/motor combinations which are mass produced for general use in vacuum cleaners. For this purpose such air pump/motor combinations include a pump mounted coaxially with and driven by an electric motor and will be hereinafter referred to as of the type described. These air pump/motor combinations mostly pass the compressed air from the pump through the motor for cooling purposes.

When such air pump/motor combinations are used for spas they often suffer premature failure. Frequently this is attributable to the motor overheating upon start-up during the period of little or no air circulation through the motor as the water is being purged from the air lines. In many installations these lines are relatively long. This is often exacerbated by accommodating the motor within a confined insulated housings in an effort to reduce the noise emitted from such motors which may spin a centrifugal pump impeller some 20,000 RPM.

Failure also occurs as a result of the contamination of the motor with chlorine or salt condensing from the spa water which fills the air supply lines upon shutdown. In conventional arrangements the return air from the pool is focussed on the motor and condenses on the steel housing and metal parts thereof. This corrodes the electrical components and causes or attributes to such failures.

The present invention aims to alleviate at least one of the abovementioned disadvantages and to provide air pump assemblies which will be reliable and efficient in use.

With the foregoing in view, this invention in one aspect resides broadly in an air pump assembly including: anair pump of the type described;

- a partitioning wall through which the air pump extends with the motor at the opposite side thereof to the centrifugal pump;
- an open pump housing closed by the wall;
- an air inlet to the pump housing and associated confining means confining the air inlet to the pump inlet;
- an open motor housing sealably engaged with the pump housing to form a sealed air pump housing assembly;
- an air outlet from the air pump housing assembly, and
- air communication means between the motor housing and the pump housing.

This arrangement has the advantage of simplicity of assembly in that the air pump may be mounted to the wall and then engaged with the pump housing so as to sealably engage the air inlet with the pump inlet. Thereafter the assembly may be completed by securing the motor housing to the pump housing. Preferably the housing parts are moulded complementary plastics components to facilitate manufacture and assembly.

The air outlet may be in the motor housing but preferably the air outlet is in the pump housing so that return air or water vapour is somewhat isolated from the motor housing.

It is also preferred that the air outlet be formed at a lower part of the pump housing and that the air communication means be spaced above the air outlet.

In the case of a vertical pipe mount the air outlet is preferably in the form of a pipe joint having an axis substantially at right angles to the impeller axis and that the air inlet be substantially co-axial with the impeller axis. The pump housing may also be provided with means for attaching it to a mounting base for non-pipe support installations. In such arrangements the air communication means may be apertures through the wall, which can be above the pipe joint when the air pump assembly is supported on a pipe or on a base.

These arrangements of the air outlet have the advantage that return air impinges directly on the pump casing where it will preferentially condense thus reducing damage to the motor. Further any return water will accumulate in the pump housing before passing to the motor housing, thus reducing the occurrence of water damage to the motor.

Preferably the motor housing is relatively voluminous so as to provide significant air space around the motor which may absorb heat during start up. This will prolong the time taken to overheat the motor and increase the chance of purging the air supply pipes prior to damaging the motor. enabling It is also preferred that the air inlet be in an end wall of the pump housing. Suitably the pump housing is secured to an air flow housing which provides a circuitous and preferably broken air path to the air inlet so as to dampen noise emission from the pump. The air flow housing may include baffles forming a maze type path. The air flow housing may also communicate with separate flow passages, or flow passages moulded with the pump housing and the motor housing, to position the intake to the air flow at the opposite side of the air pump housing assembly as the air inlet.

This arrangement achieves noise reductions without increasing the complexity of assembly of the air pump assembly. The simple layered type assembly of the air pump assembly as variously defined above also constitutes another aspect of this invention.

In order that the various aspects of this invention may be more readily understood and put into practical effect, reference will now be made to accompanying drawing which is a diagrammatic exploded illustration of one form of air pump assembly.

The air pump assembly 10 illustrated in the drawing is in the form of a housing assembly 11 formed from moulded plastics material and adapted to support an air-diving device (17) of the type described for the supply of air through an outlet connection 13 to the air supply pipe of a spa or the like.

The housing assembly 11 includes a pump housing 14 and a similar but opposed motor housing 16 which are adapted to engage sealably with the respective opposed faces of an air pump mounting wall 18. This wall 18 has peripheral location formations 19 around its opposed peripheries for engagement with the substantially identical inner faces 20 of the pump and motor housings 14 and 16.

Each of the housings 14 and 16 is divided into two chambers, the larger of which is provided with an end wall 21 and 22 respectively, while the smaller chambers have no end walls and provide ducts 27 and 28 which communicate through an aperture 23 in the wall 18 to form a through passage extending between the opposed end caps 25 and 26 which are secured by screws about the end walls 21 and 22 respectively through apertures provided.

The end wall 21 is apertured at 30 coaxially with the axis 31 of the air-driving device (12) to provide an air inlet to the central pump opening which is shown in dotted outline at 32. A resilient annular spacer 33 is disposed between the end wall 21 and the inlet 32 so as to accommodate the gap therebetween and to isolate the inlet from the interior of the housing 14. Different spacers are utilised to match the housing 11 to different air pumps.

Furthermore, it will be seen that the lower cap 25 has an air flow baffle 35 extending in from its end wall 36 which is provided to split the air flow entering the lower cap 25 through the ducts 27 and 28 before passing upwardly through the inlet 30 to the pump motor assembly (24). Air is received through a plurality of intake apertures 40 formed in the upper cap 26.

Thus, air flows through the intake ports 40 down through the ducts 27 and 28 and aperture 23 and into the lower cap 25 for passage about the flow splitter or baffle 35. High pressure air from the pump 24 is discharged through the motor 50 confined within the pump and motor housings 14 and 16 for passage through the outlet 13 as indicated. Apertures 44 in the dividing wall 18 provide an air flow between the motor 50 an the outlet 13.

The above construction facilitates very simple assembly of the pump assembly as follows. The motor 50 is passed through the aperture 51 in the wall 18 and it is secured thereto by screws passing through formed apertures 53 therein into threaded apertures in the back wall 54 of the pump housing. The wall 18 together with the secured air pump is then engaged with the pump housing 14, clamping the spacer 33 between the pump inlet 32 and the inlet 30, and is screwed into position through the screw flutes/apertures 52 provided. A sealant such as silicon adhesive/sealant can also be utilised at the joint to ensure an airtight joint is made.

Subsequently, the motor housing 16 is secured over the motor to the upper face of the wall 18 and screwed and glued into position through the complementary flanges 29. A sealant such as silicon adhesive/sealant can also be utilised at the joint to ensure an airtight joint is made. This forms a chamber about the air-driving device (12) which is sealed other than for the inlet 30 and the outlet 13. This assembly also forms a vertical duct through the passages 27 and 28 enabling the end caps 25 and 26 to communicate with one another.

The caps 25 and 26 are screwed to their respective housings prior to assembly of the pump and motor housings to one another. Of course wiring is added as required and passed through a suitable aperture in the pump housing wall so that the motor may be supplied with electricity.

In use, if the air pump assembly 10 is mounted horizontally as illustrated, or with the outlet fitted about the upper end of an upstanding pipe, air will be pumped therethrough after being received through the air the air flow path which is both circuitous and split so that the external noise should be significantly attenuated, especially the high pitch shrill emanating from the high speed rotor.

During start up, while air flow is minimum as the air lines are being purged of water, the motor 50 operates in a relatively large chamber which provides cooling air for the additional seconds required to purge the line to enable air circulation to begin and normal motor cooling to be effected.

When pumping ceases and the air lines fill with water, the return air will be directed through the inlet 13 onto the pump housing where it will be mostly condensed prior to passing through the apertures 44 into the motor housing. In a horizontal installation as illustrated water entering the inlet 13 will have to fill the pump housing 14 prior to entering the motor housing 16. In a vertical installation with the air pump assembly 10 mounted on the upper end of a pipe, water will have to fill the lower part of the pump housing 14 before passing through the apertures 44 into the motor housing 16 and both housing must then be partially filled prior to water contacting the motor 50.

Thus the motor will normally be maintained above water levels in the housing 11.

The end cap 25 and/or end cap 26 may be made from a different plastics material from the remainder of the housing such as a softer sound attenuating material. The end cap 25 may also be lined with a sound deadening material such as a spray-in mastic or self skinning foam or the like to further assist with sound deadening of the noise emanating from the air pump. This together with the circuitous air flow path, the splitting of the flow and the sealed containment of the air-driving device (12) should greatly assist in reducing the noise emitted by the air pump assembly 1O.

It will of course be realised that while the above has been given by way of illustrative example of this invention, all such and other modifications and variations thereto as would be apparent to persons skilled in the art are deemed to fall within the broad scope and ambit of this invention as is defined in the appended claims.

The claims defining this invention are as follows:

1. An air pump assembly comprising:

an air-driving device;

a motor for driving said air-driving device;

a pump housing including a partition, said partition creating a pump chamber and a motor chamber, said air-driving device being disposed in said pump chamber, said motor being disposed in said motor chamber, at least one outlet opening being formed in a perimeter of said pump housing;

a first air chamber having at least one inlet opening for the intake of air, said first air chamber being disposed on a top of said pump housing; and a second air chamber being disposed on a bottom of said pump chamber, an air passage connecting said first and second air chambers, a housing opening being formed in a bottom of said pump housing.

2. The air pump assembly of claim 1, further comprising:

a curved baffle being disposed in said second air chamber, said curved baffle causing air to rotate and be forced through said housing opening.

3. The air pump assembly of claim 1 wherein:

said motor being a flow through type and said air-driving device being a flow through type.

4. The air pump assembly of claim 3 wherein:

at least one partition opening being formed through said partition.

5. The air pump assembly of claim 1 wherein:

said at least one outlet opening being substantially perpendicular to an axis of said air-driving device.

6. The air pump assembly of claim 1 wherein:

said at least one outlet opening being formed in a perimeter of said pump housing adjacent said air pump.

7. The air pump assembly of claim 1 wherein:

said pump housing having means for attachment to a mounting base.

8. The air pump assembly of claim 1 wherein:

said motor chamber having a volume which is at least three times the volume of said motor.

9. An air pump assembly comprising:

an air-driving device being a flow through type;

a motor for driving said air-driving device, said motor being a flow through type;

a pump housing including a partition, said partition creating a pump chamber and a motor chamber, said air-driving device being disposed in said pump chamber, said motor being disposed in said motor chamber, at least one outlet opening being formed in a perimeter of said pump housing;

a first air chamber having at least one inlet opening for the intake of air, said first air chamber being disposed on a top of said pump housing;

a second air chamber being disposed on a bottom of said pump chamber, an air passage connecting said first and second air chambers, a housing opening being formed in a bottom of said pump housing; and at least one partition opening being formed through said partition.

10. The air pump assembly of claim 9 wherein:

a curved baffle being disposed in said second air chamber, said curved baffle causing air to rotate and be forced through said housing opening.

11. The air pump assembly of claim 9 wherein:

said at least one outlet opening being substantially perpendicular to an axis of said air-driving device.

12. The air pump assembly of claim 9 wherein:

said at least one outlet opening being formed in a perimeter of said pump housing adjacent said air-driving device.

13. The air pump assembly of claim 9 wherein:

said pump housing having means for attachment to a mounting base.

14. The air pump assembly of claim 9 wherein:

said motor chamber having a volume which is at least three times the volume of said motor.

15. A method of pumping air in an air pump assembly comprising the steps of:

providing a pump housing, air-driving device, and motor for driving said air-driving device:

flowing an input of air from a top of said pump housing to a bottom of said pump housing;

forming a partition in said pump housing separating said air-driving device from said motor;

forming at least one partition opening through said partition; and flowing said input of air through a bottom of said pump housing, said air-driving means, said motor, said at least one partition opening, and out through at least one outlet opening formed in said pump housing.

16. The method of reducing condensation in an air pump assembly of claim 15, further comprising the step of:

forming an air chamber on a bottom of said pump chamber, a curved baffle being disposed in said air chamber, said curved baffle causing air to rotate and be forced in said pump housing.

17. The method or pumping air in an air pump assembly of claim 15, further comprising the step of:

forming said at least one outlet opening through a perimeter of said pump housing adjacent said air-driving device.

18. The method of pumping air in an air pump assembly of claim 15, further comprising the step of:

providing said pump housing with means for attachment to a mounting base.

19. The method of pumping air in an air pump assembly of claim 15, further comprising the step of:

creating a motor chamber with said partition, said motor chamber having a volume which is at least three times the volume of said motor.

* * * * *